United States Patent [19]

Hermach

[11] Patent Number: 4,620,480

[45] Date of Patent: Nov. 4, 1986

[54] CONVERSION OF LETTERPRESS TO OFFSET PRINTING

[75] Inventor: Carl J. Hermach, Gulfport, Fla.

[73] Assignee: Publishers Equipment Corporation, Carrollton, Tex.

[21] Appl. No.: 209,222

[22] Filed: Nov. 24, 1980

Related U.S. Application Data

[63] Continuation-in-part of Ser. No. 175,126, Aug. 4, 1980, abandoned, which is a continuation-in-part of Ser. No. 122,908, Feb. 20, 1980, abandoned.

[51] Int. Cl.[4] ..... B41F 5/22; B41F 13/08

[52] U.S. Cl. ..... 101/179; 101/216; 101/220

[58] Field of Search ..... 101/177, 178–182, 101/183–185, 219, 220, 221, 247, 351, 352, 216, 153, 152, 137, 138, 139, 140–145; 308/62, 121

[56] References Cited

U.S. PATENT DOCUMENTS

| | | | |
|---|---|---|---|
| 1,647,387 | 11/1927 | Wood | 101/220 |
| 2,568,761 | 9/1951 | Peyrebrune | 101/218 |
| 2,986,086 | 5/1961 | Siebke | 101/218 |
| 3,072,050 | 1/1963 | Wolff | 101/177 |
| 3,361,490 | 1/1968 | Bassan | 308/62 X |
| 3,470,816 | 10/1969 | Piecha et al. | 101/216 |
| 3,732,813 | 5/1973 | Singh et al. | 101/247 X |
| 3,785,287 | 1/1974 | Dahlgren | 101/247 |

*Primary Examiner*—J. Reed Fisher
*Attorney, Agent, or Firm*—Robert V. Jambor

[57] ABSTRACT

A method and apparatus for conversion of a web fed letterpress unit (10) into a web fed offset printing press unit (42) having a main frame (12) an internal support such as an internal auxiliary frame (44) inside the main frame for receiving cylinders, a pair of offset plate cylinders (46 and 46*a*) for mounting printing plates thereon, an inking arrangement (16, 18 and 20) for applying films of ink to the plates, and a pair of blanket cylinders (48 and 48*a*) in close proximity to a position for respective rolling contact with the plates on the plate cylinder and the other blanket cylinder. An offset press gear train (54) is installed outside the frames with the shafts for the cylinders extended through bores (60*b*, 61*b*, 62*b* and 112) provided in the main frame. The offset unit also includes external support such as external auxiliary frame (45) affixed to the outside of the main frame between the main frame and the gear train. Eccentric sleeves (68) are installed for bodily swinging cylinders between alternative positions. Eccentric sleeves (68*b*) on the side of the press unit with the external auxiliary frame extend from the internal auxiliary frame to the external auxiliary frame in one arrangement.

In one arrangement the internal and external supports include individual support brackets affixed to the frame which support offset cylinders including the related sleeves and bearings.

7 Claims, 13 Drawing Figures

CONVERSION OF LETTERPRESS TO OFFSET PRINTING

This application is a continuation-in-part of U.S. application Ser. No. 175,126, entitled "Conversion of Letterpress to Offset Printing", filed Aug. 4, 1980, now abandoned which is a continuation-in-part of U.S. application Ser. No. 122,908, entitled "Conversion of Letterpress to Offset Printing", filed Feb. 20, 1980, now abandoned.

TECHNICAL FIELD

The present invention relates generally to printing presses, and in one of its aspects, to a method and apparatus for converting a web fed letterpress unit into a web fed offset printing press unit.

The news publishing industry has billions of dollars worth of letterpress equipment. The newspaper industry has, however, been switching from letterpress to offset printing for numerous reasons including improved quality of the print and lowered operating cost. Until recently, publishers have had little option other than to purchase new offset equipment to replace their letterpress equipment.

The frames for the letterpress units are massive and reboring the frames in place for insertion of offset cylinders is impractical. Often reboring is impossible because the new bores would overlap the old bores. Moreover, completely replacing the equipment or completely reworking it is very time consuming.

BACKGROUND ART

A conversion known as direct lithographic or "di-litho" simply replaces the letterpress plate and impression cylinders with offset plate and blanket cylinders. In the di-litho process, the web is fed between the di-litho plate and blanket cylinders so that the process is not a true offset printing process.

DISCLOSURE OF INVENTION

In accordance with an invention of the present inventor and Duane H. Houy which is the subject matter of U.S. patent application Ser. No. 32,240 filed Apr. 20, 1979, and assigned to the same assignee as the present invention, a method for converting a web fed letterpress unit having a main frame, a pair of plate cylinders laterally spaced in the frame for mounting printing plates thereon, means for applying films of ink to the plates, and a pair of impression cylinders in respective rolling contact with the plates on the plate cylinder, into a web fed offset printing press unit includes removing the pair of letterpress plate cylinders and the pair of letterpress impression cylinders. Internal support means for rotatably supporting offset cylinders in the offset printing configuration with a bearing internal to the main frame is affixed to the main frame. One embodiment of the internal support means includes an auxiliary frame. A lower portion of an auxiliary frame for receiving offset cylinders in an offset printing press configuration is placed inside the main frame. A pair of offset plate cylinders is then installed. The offset plate cylinders might fit into the bores and bearings for the letterpress plate cylinders in which case they can be installed directly, otherwise one or both of the offset plate cylinders is installed in the auxiliary frame. The lower portion of the auxiliary frame is then installed, using pilots to guide the installation of the auxiliary frame. The pilots, in one embodiment, are afixxed to the auxiliary frame and are designed to be inserted into the original cylinder bores of the main frame. After the auxiliary frame is installed, a pair of blanket cylinders is installed in close proximity to a position for respective rolling contact with the plates on the plate cylinder and the other blanket cylinder. In some circumstances the lower portions of the auxiliary frame are completely installed prior to the installation of the plate cylinders.

It is common for letterpress units to also have a pair of laterally spaced form rollers in respective rolling contact with the plates on the plate cylinder. A preferred conversion according to that method includes removing the at least one pair of form rollers, and mounting micrometric adjusting sockets for receiving the form rollers for respective rolling contact between the at least one pair of form rollers with the plates of the plate cylinder after the pair of offset plate cylinders is installed. It is also preferred to plate the ink drums with copper, and add dampener motions.

The gear train used to drive the letterpress unit cylinders is not suitable for driving the offset cylinders. A new offset gear train must, therefore, be installed for imparting motion from one of the offset press unit cylinders to other offset press unit cylinders. Some of the gears for the letterpress unit can be removed, but many will still be used for driving at least one of the cylinders and for driving the inking drums. In converting some letterpress units, it will be possible to extend the shaft of the offset cylinders through the bores for the letterpress unit cylinders in the main frame by removing the bearings for the letterpress cylinders. In such a case, the offset gear train can normally be installed on the outside of the main frame to allow more room inside the frames for wider web widths. With the cylinder shafts supported by the auxiliary frame inside the main frame, unwanted vibrations are caused by supporting the weight of the gears on the outside of the main frame. Otherwise, the offset gear train can be installed inside of the main frame, but installation of the gear train inside the main frame makes it difficult to access the gears for maintenance and impossible to remove the gears without removing the upper portions of the auxiliary frame and the cylinders.

Considering the cylinders to include both the drum body and the shaft, it is frequently necessary to make the drum bodies for the offset press shorter than the drum bodies were for the letterpress in order to allow additional room for the auxiliary frame and the offset gear train when it is inside the main frame. This shortening of the drum bodies narrows the allowable web width, but this normally does not present a problem in the United States since the industry has fairly well settled on a 58 inch web width which is sufficiently narrower than the typical 68 inch web width for which most letterpress units were designed. This does, however, present a problem in Europe and other countries that still use a wider web width. The total length of the cylinders is also shorter when the shafts cannot extend through the main frame bores for the letterpress cylinders.

A preferred conversion according to that method and apparatus includes the installation of means for bodily swinging various cylinders into different positions for different printing arrangements and for throw-off in case of web wrap, for changing plates, or other cylinder maintenance.

A special method according to that invention for converting a letterpress unit that has at least a half deck with a deck plate cylinder and a deck impression cylinder is to remove the deck impression cylinder, install a deck blanket cylinder in a position for rolling contact with the plates of the deck plate cylinder, if necessary replacing the deck plate cylinder with a deck offset plate cylinder, and installing an impression cylinder in the vicinity of the cusp formed by the pair of blanket cylinders for placing in rolling contact with the deck blanket cylinder and for placing in rolling contact with all three cylinders, the deck blanket cylinder and the pair of offset blanket cylinders. This method also includes the situation where there is a full deck, the full deck being simply two half decks.

In a conversion involving at least one half deck, a means is installed for bodily swinging each of the blanket cylinders and the impression cylinder between a first position in which the blanket cylinders make contact with the plates of their respective plate cylinders and with the impression cylinder, a second position in which the pair of blanket cylinders make contact with each other and are isolated from the impression cylinder, and the deck blanket cylinder makes contact with the impression cylinder, and a third position in which the blanket cylinders and the impression cylinder are displaced into a throw-off position in which the blanket cylinders are isolated from their associated cylinders. Such a method can also include installing a means for bodily swinging the remaining offset cylinders wherein all offset cylinders are displaced in the third position.

A method according to the present invention will also include providing bores in the main frame for receiving the shafts of offset cylinders in an offset printing press configuration, and installing an external support means affixed to the main frame for rotatably supporting offset cylinders with a bearing outside the main frame. One such external support includes a lower portion of an external auxiliary frame on the outside of the main frame for receiving the offset cylinders. An upper portion of the external auxiliary frame could be installed at the same time so that the shafts of the offset printing cylinders are slid through the bores in the external auxiliary frame, although it is preferable to install the upper portion of the frame along with the upper portions of the internal auxiliary frame after the cylinders have been lowered into position. Providing bores in the main frame for receiving the shafts of the offset cylinders includes taking advantage of the already existing bores for the letterpress cylinders, enlarging those bores where necessary, and forming new bores where necessary. These do not have to be precision bores and can be quite rough since the offset cylinders will be supported by the auxiliary frames in most cases, and simply need to pass through the main frame.

In one combination according to the present invention, the internal support means includes support brackets which support the offset cylinders, each support bracket associated with a particular bore. Pilots are affixed to the brackets for positioning the brackets with respect to their respective bores. In one embodiment, the external support means also includes such support brackets and pilots. The brackets receive at least one end of the cylinder shafts for the offset cylinders which have been relocated with respect to the letterpress cylinders which they replace.

These and other objects, advantages and features of this invention will be apparent from the following description taken with reference to the accompanying drawings, wherein is shown the preferred embodiments of the invention.

BEST MODE FOR CARRYING OUT THE INVENTION

Figure 1:
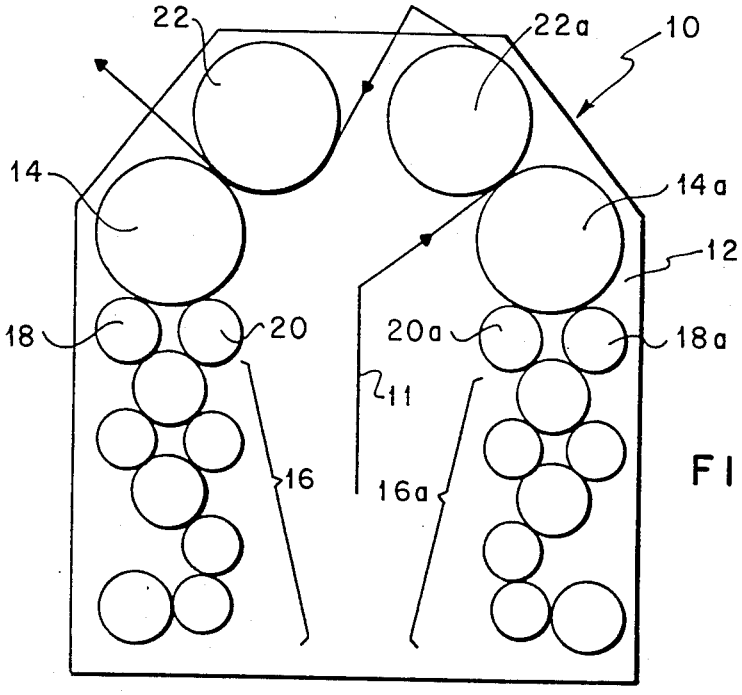
FIG. 1 is a diagramatic cross-sectional view taken from one end of a web fed letterpress unit.

Referring now to the drawing, and in particular to FIG. 1, a typical web fed letterpress unit, referred to generally by reference numeral 10 prints on both sides of a web 11. Letterpress unit 10 includes a main frame 12, a pair of plate cylinders 14 and **14*a* laterally spaced in frame 12 for mounting printing plates thereon, means including ink transfer rollers and cylinders or drums 16 and 16*a* and form rollers 18, 18*a*, 20 and 20*a* for applying films of ink to the plates. Letterpress unit 10 also includes a pair of impression cylinders 22 and 22*a* in respective rolling contact with the plates on the plate cylinder 14 and 14*a***, respectively.

Figure 2:
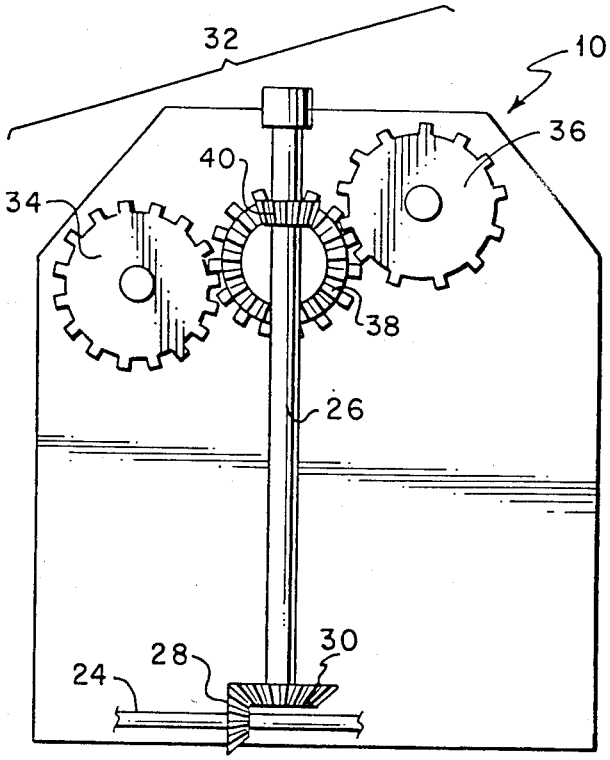
FIG. 2 is a diagramatic end view of the letterpress unit of FIG. 1.

Referring also to FIG. 2, the letterpress unit is driven by a horizontal shaft 24 which drives a vertical drive shaft 26 through bevel gears 28 and 30. Vertical drive shaft 26 in turn drives the letterpress cylinders through gear train 32 which includes a spur drive gear 34 for cylinder 14, a spur drive gear 36 for impression cylinder **22*a* and a spur gear-bevel gear combination 38 driven by vertical shaft 26 through bevel gear 40. On the far end of frame 12 are mounted spur gears corresponding to each of the plate cylinders 14 and 14*a* and each of the impression cylinders 22 and 22*a* so that the gear for plate cylinder 14 drives the gear for impression cylinder 22, and the gear for impression cylinder 22a drives the gear for plate cylinder 14a**.

Figure 3:
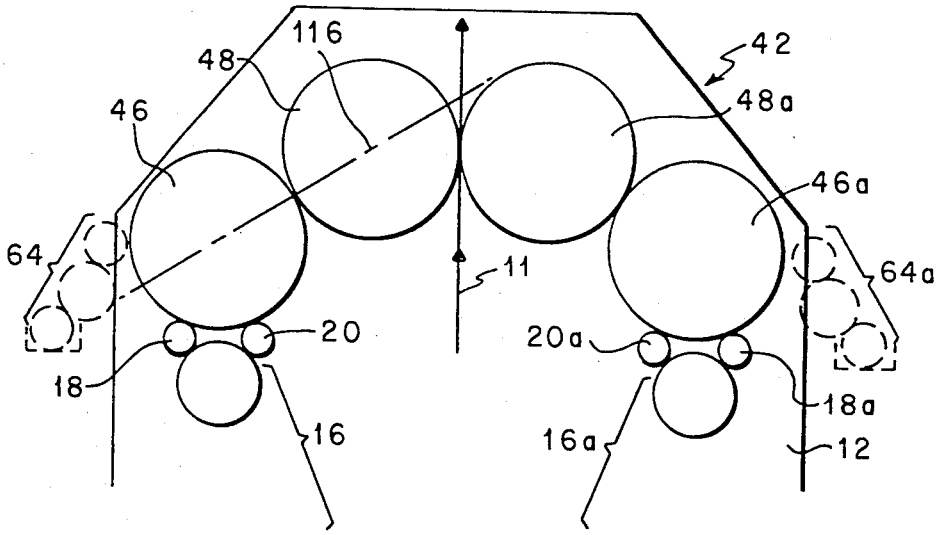
FIG. 3 is a diagramatic sectional view similar to that of FIG. 1 of the press of FIG. 1 after it has been converted to a web fed offset printing press unit.
Figure 4:
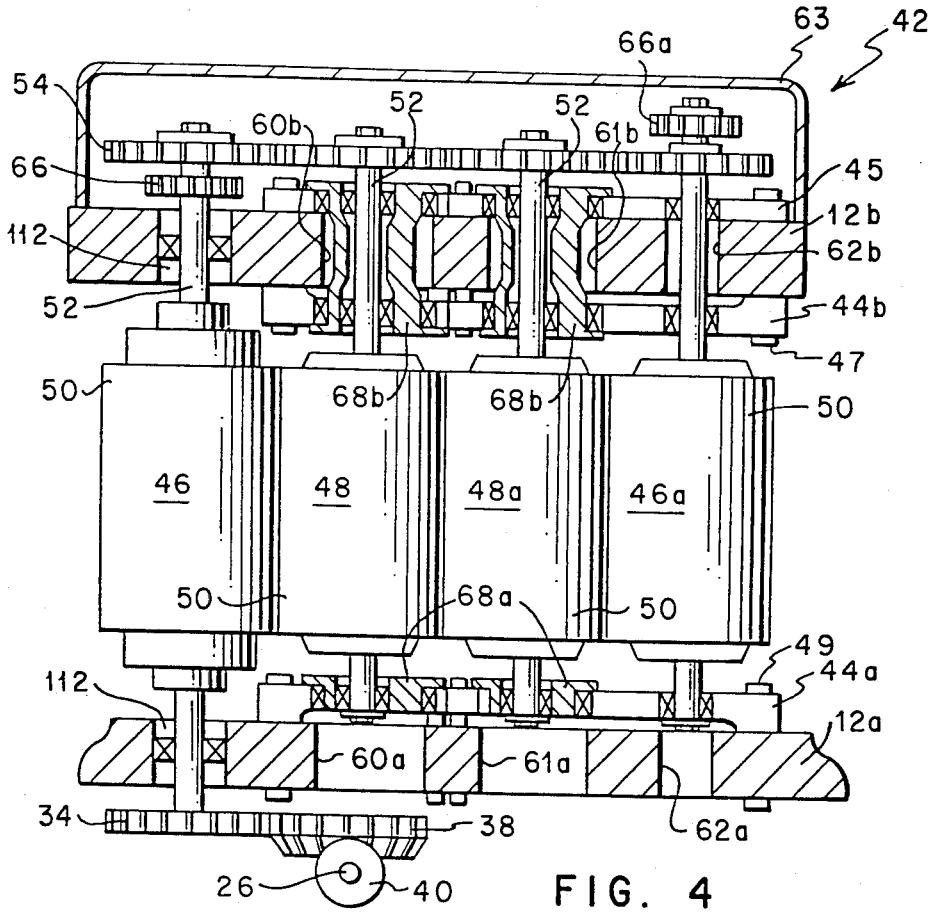
FIG. 4 is a top view of the offset printing press unit of FIG. 3 partly in section to show the bores in the press main frame.

Referring now to FIGS. 3 and 4, a web fed offset printing press unit converted from web fed letterpress unit 10 of FIGS. 1 and 2 is referred to generally by reference numeral 42. It includes main frame 12 comprising drive side main frame 12a and operating side main frame 12b, ink transfer rollers and drums 16 and 16a, and form rollers 18, 18a, 20 and 20a. It also includes the same driving mechanism through vertical shaft 26, bevel gear 40, combination spur gear-bevel gear 38 and spur gear 34. Offset press unit 42, however, also has an internal support means for rotatably supporting cylinders in an offset configuration, in this embodiment internal support means includes an internal auxiliary frame 44, affixed to main frame 12, comprising drive side internal auxiliary frame 44a and operating side internal auxiliary frame 44b inside main frame 12 for receiving cylinders. The internal support means is internal in that it has bearing inside the main frame. A pair of offset plate cylinders 46 and 46a are laterally spaced inside the frames for mounting printing plates thereon, and a pair of blanket cylinders 48 and 48a are inside the frames in close proximity to a position for rolling contact with the plates on the respective plate cylinder, cylinder 46 or 46a, and each other. Considering cylinder 46 to include a drum 50 and a shaft 52, it can be seen that the shaft for some cylinders extends beyond auxiliary frame 44 and even beyond main frame 12. The cylinders are thus "inside the frames" in the sense that they are primarily between drive side main frame 12a and operating side main frame 12b.

Offset unit 42 also includes an external support means for rotatably supporting offset cylinders, external support means in this embodiment includes an external auxiliary frame 45 affixed to the outside of main frame 12. In the particular embodiment illustrated, external auxiliary frame 45 and operating side internal auxiliary frame 44b are bolted to operating side main frame 12b by bolts 47. Similarly, drive side internal auxiliary frame 44a is bolted to drive side main frame 12a by bolts 49.

Web fed offset printing press unit 42 also includes a gear train 54 outside of operating side main frame 12b for imparting motion from one of the cylinders, cylinder 46 in this case, to other cylinders, in this case cylinders 48, 48a and 46a. It may be necessary to shorten drums 50 of the cylinders somewhat in order to allow more room within main frame 12 for auxiliary frame 44. Gear train 54 can be moved outside of main frame 12 even if the shafts 52 of cylinders 46, 46a, 48 and 48a do not align with bores 76, 56a, 56b, 58a and 58b for the letterpress unit cylinders since bores 60b, 61b, and 62b have been provided by enlarging the original bores. In some cases bores for offset cylinders are provided by simply removing the bearings for the letterpress cylinders. Many letterpress units have enough room in existing oil tight housing 63 for the addition of gear train 54. In the embodiment illustrated, it is possible to keep gear train 54 closer to the bearing supports for shafts 52 by moving inking gear 66a to the outside of gear train 54, thus further reducing gear overhang.

A method for converting web fed letterpress unit 10 of FIGS. 1 and 2 into web fed offset printing press unit 42 of FIGS. 3 and 4 comprises in combination the steps of removing the pair of letterpress plate cylinders 14 and 14a and the pair of letterpress impression cylinders 22 and 22a, placing inside main frame 12 a lower portion of an internal auxiliary frame 44 comprising drive side internal auxiliary frame 44a and operating side internal auxiliary frame 44b for receiving offset cylinders in an offset printing press configuration, installing a pair of offset plate cylinders 46 and 46a, installing the lower portion of auxiliary frame 44, and installing a pair of blanket cylinders 48 and 48a in close proximity to a position for respective rolling contact with the plates on plate cylinder 46 and 46a respectively and the other blanket cylinder. The lower portions of the auxiliary frames can, of course, be completely installed prior to installing the cylinders, and the invention is not limited to the particular order of operations. It is simply easier to at least have the lower portions already inside the main frame before the cylinders are in place.

A preferred method according to the present invention also includes installing a lower portion 45b of an operating side external auxiliary frame and installing an offset printing configuration gear train 54 on the outside of operating side external auxiliary frame 45. The method also includes, prior to installing the lower portion of any auxiliary frame, positioning a template representative of that auxiliary frame against the respective side of the main frame, and with the template as a guide, forming holes in the main frame for bolting the auxiliary frame to the respective side of the main frame. Installing an auxiliary frame includes bolting the auxiliary frame to the main frame with bolts 47.

The method also includes installing means 68 for bodily swinging cylinders through short radius arcs, which in the embodiment illustrated are eccentric sleeves, in the auxiliary frames extending from internal auxiliary frame 44b to external auxiliary frame 45 through bore holes 60b and 61b of main frame 12b for rotatably receiving the respective offset cylinders. Eccentric sleeves 68 on the drive side are simply rotatably mounted in drive side auxiliary frame 44a. The step of providing bores in main frame 12 comprises, where necessary, enlarging the bore sufficiently for receiving the eccentric sleeves on the operating side.

A preferred method includes removing at least one pair of form rollers, either 18 and 18a or 20 and 20a or both pairs, mounting micrometric adjusting sockets for receiving the form rollers for respective rolling contact by the form rollers with the plates of plate cylinders 46 and 46a after the pair of offset plate cylinders is installed, and then installing the at least one pair of form rollers. It is also preferred that the ink drums of 16 and 16a be plated with copper, and that dampeners 64 and 64a along with dampener motions be added. Gear train 54 is also added. Gears 66 and 66a are added to plate cylinders 46 and 46a respectively for driving the inking rollers and drums. Means 68 for bodily swinging each of blanket cylinders 48 and 48a is installed. Means 68 is for bodily swinging the cylinders between a first position in which the blanket cylinders make contact with their respective plate cylinders and with each other for applying an inked image on opposite sides of a web fed between them, and a second position in which the blanket cylinders are displaced into a throw-off position in which the blanket cylinders are isolated from their associated cylinders. Means 68 can be manually or hydraulically turned eccentric bearings. Such mechanisms are common in printing presses and are described in detail in U.S. Pat. No. 3,329,086, issued to Pullen. Means 68 can also be installed for bodily swinging each of the plate cylinders, and the positions mentioned can be accomplished by bodily swinging both plate cylinders and blanket cylinders.

Figure 5:
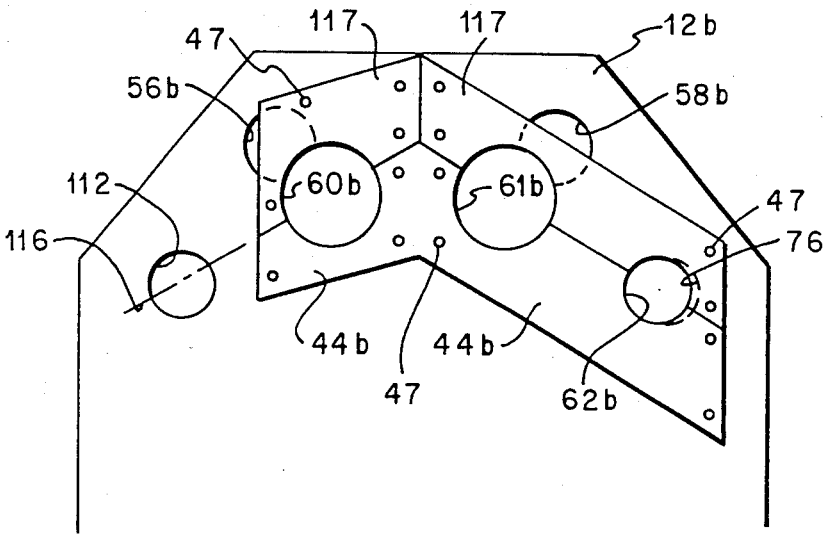
FIG. 5 is a view similar to that of FIG. 3 of the offset press unit of FIGS. 3 and 4 with the cylinders removed.

Only a lower portion of auxiliary frames 44 and 45 has been discussed, and in some situations this may be the entire auxiliary frame. Referring again to FIGS. 3 and 5, another embodiment of a lower portion of auxiliary frame 44 will leave the bores for the cylinders exposed so that the offset cylinders can simply be lowered into place. The location of the top of such a lower portion is illustrated by line 116. A cap 117 is then attached to hold the cylinders and their respective bearings in place. This is similar to the common practice of capping main frames.

It can now be seen that the present invention allows the removal of gears to the outside of the converted press frame which allows more room for the cylinders and, thus, a wider web width. It also reduces the cost of conversion from letterpress to offset printing. Having a third bearing surface on the operating side reduces the length of the gear overhang. The same apparatus could, of course, be used for reducing gear overhang on driving side gears. Moving the gears to the outside also allows more space for sockets and throw-off mechanisms. The present invention takes advantage of the existing oil tight housing on the operating side of the press unit. The present invention can easily be applied to color units and other units having a half deck or full deck. The present invention permits the use of smaller and double bearings on the blanket cylinders. The present invention also permits the use of rough bored holes in the main frame when necessary to enlarge or add bores. This is extremely important because of the difficulty of precision drilling holes in the main frame on site. Additionally, keeping the gears on the outside of the main frame allows the bearing surfaces on the internal auxiliary frame to be closer to the main frame, thus reducing the stress on the auxiliary frame.

Figure 6:
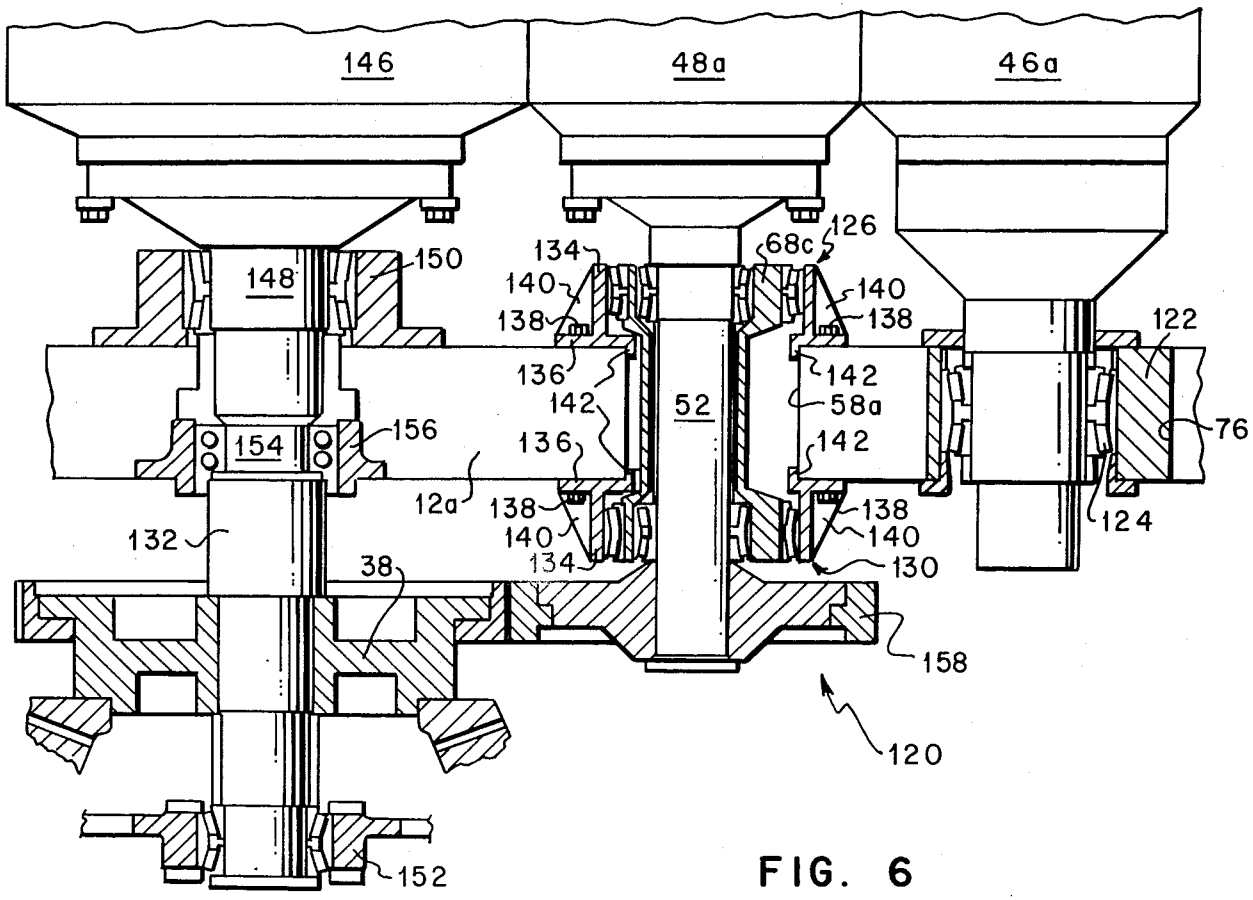
FIG. 6 is a detail of a view similar to the view in FIG. 4 of an alternative embodiment, but taken at a right angle to the exposed edge of the main frame where the cap has been removed.
Figure 7:
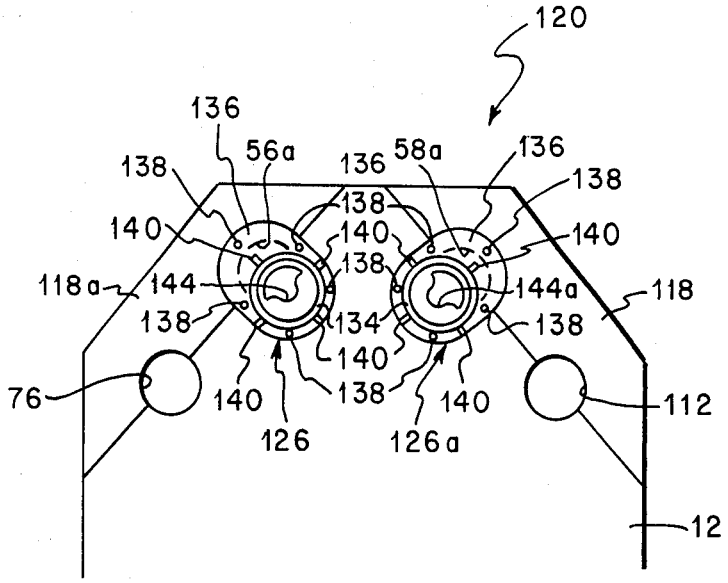
FIG. 7 is a view similar to that of FIG. 3 except of the drive side of the offset press unit of FIG. 6 with the cylinders removed.

Referring now to FIG. 6 and FIG. 7, an alternative embodiment according to the present invention is referred to generally be reference numeral 120. In the description, like parts are given like numbers to those used in the descriptions of other embodiments. Main frame 12 has caps 118 and 118*a* which can be removed and which were originally used to aid in inserting letterpress cylinders into bores 112, 56*a*, 58*a* and 76. In embodiment 120 illustrated, plate cylinder 46*a* is rotatably supported by eccentric sleeve 122 and beveled roller bearings 124. The center of plate cylinder 46*a* in this case is moved sufficiently for proper location by means of eccentric sleeve 122 so that it is not necessary to enlarge bore 76 or install plate cylinder 46*a* in an auxiliary frame or other internal or external support means. The internal support means in this embodiment includes a plurality of support brackets 126 and 126*a* affixed to main frame 12. Each support bracket 126 and 126*a* is associated with a particular bore, 56*a* and 58*a* respectively. The support brackets support the offset blanket cylinders, but similar brackets could be used for supporting other cylinders. In the case illustrated, support bracket 126 supports blanket cylinder 48*a*. In the embodiment illustrated, the external support means includes external support brackets 130 for supporting a portion of blanket cylinder shaft 52 which extends through bore 58*a*. Support brackets 126 and 130 as well as other support brackets include a support ring 134 and a flange 136 affixed to support ring 134. Bolts 138 secure the support brackets to main frame 12 through flange 136, and strength members 140 extend between support rings 134 and flanges 136 to give added strength to support rings 134 for supporting the cylinders.

A plurality of pilots 142 are affixed to the support brackets. As an example, pilot 142 affixed to support bracket 126 is used to position bracket 126 with respect to its bore 58*a*. In order to install blanket cylinder 48*a*, a combination of support bracket 126 and pilot 142 is positioned on shaft 52 of blanket cylinder 48*a* on at least one end of the shaft, in this case the end nearest to bore 58*a*. Blanket cylinder 48*a* is then positioned within frame 12 in close proximity to a position for respective rolling contact with the plates on plate cylinder 46*a* and an impression cylinder 146. Support bracket 126 is then installed using pilot 142 to locate the bracket with respect to bore 58*a*. Preferably, the bracket is preassembled on the cylinder shaft so that the entire assembly is simply dropped into place. The pilots will make enough contact with the original bores to accurately locate the pilots and hence the support brackets and cylinders. If it is necessary to provide additional room for cylinder shafts 52 and their associated eccentric sleeves, then rough bores 144 and 144*a* can be provided adjacent to the original bores 56*a* and 58*a* respectively, but since the rough bores do not have to be the same diameter as the original bores, and in fact can be much smaller since they only have to accommodate the additional room needed by the eccentric sleeves and do not have to accommodate the bearings and other mechanisms, pilots 142 can make a precision fit with much of the original bores.

Shaft 148 of common impression cylinder 146 is supported by means 150 and 156 for rotatably supporting a shaft. Pre-existing means 152 supports outer end of shaft 148.

Gear train 158 is this embodiment allows blanket cylinders 48 and 48*a* to be driven from spur gear 38 by the common impression cylinder 146. Main frame 12 is bored so that shaft 148 extends all the way through main frame 12, supporting gear 38 and thus replacing a gear supporting shaft which was at location 132. In such an arrangement, common impression cylinder 146 is driven through gear 38. Plate cylinders 46 and 46*a* are driven on the operating side by their respective blanket cylinders.

Through such an arrangement, a web can be wrapped around common impression cylinder 146 for applying multicolor images to one side of the web. By the use of the eccentric sleeves in an arrangement with a half deck, blanket cylinders 48 and 48*a* can be moved into a blanket-to-blanket mode of operation for applying inked images to opposite side of a web fed between them.

Figure 8:
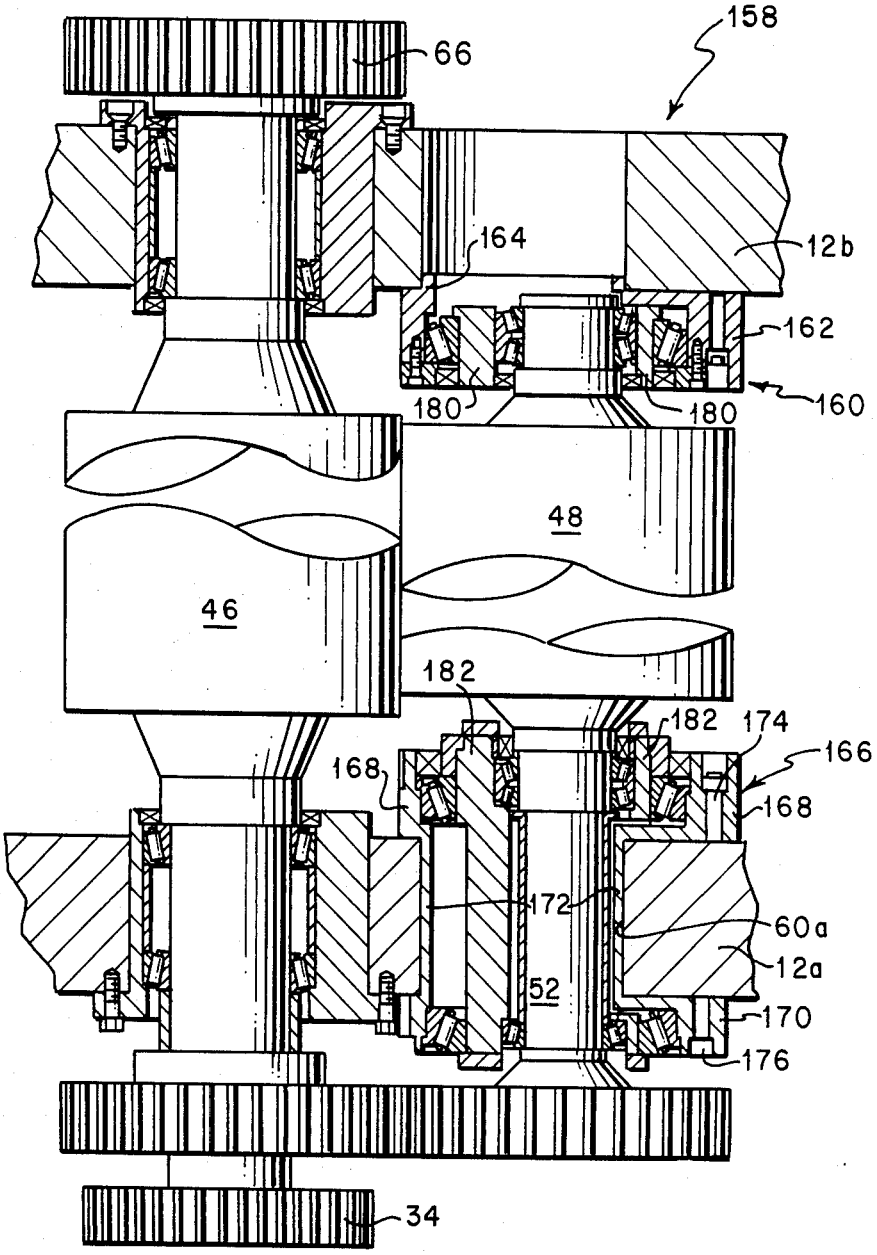
FIG. 8 is a detail of a view similar to the view of FIG. 4 of an alternative embodiment.
Figure 9:
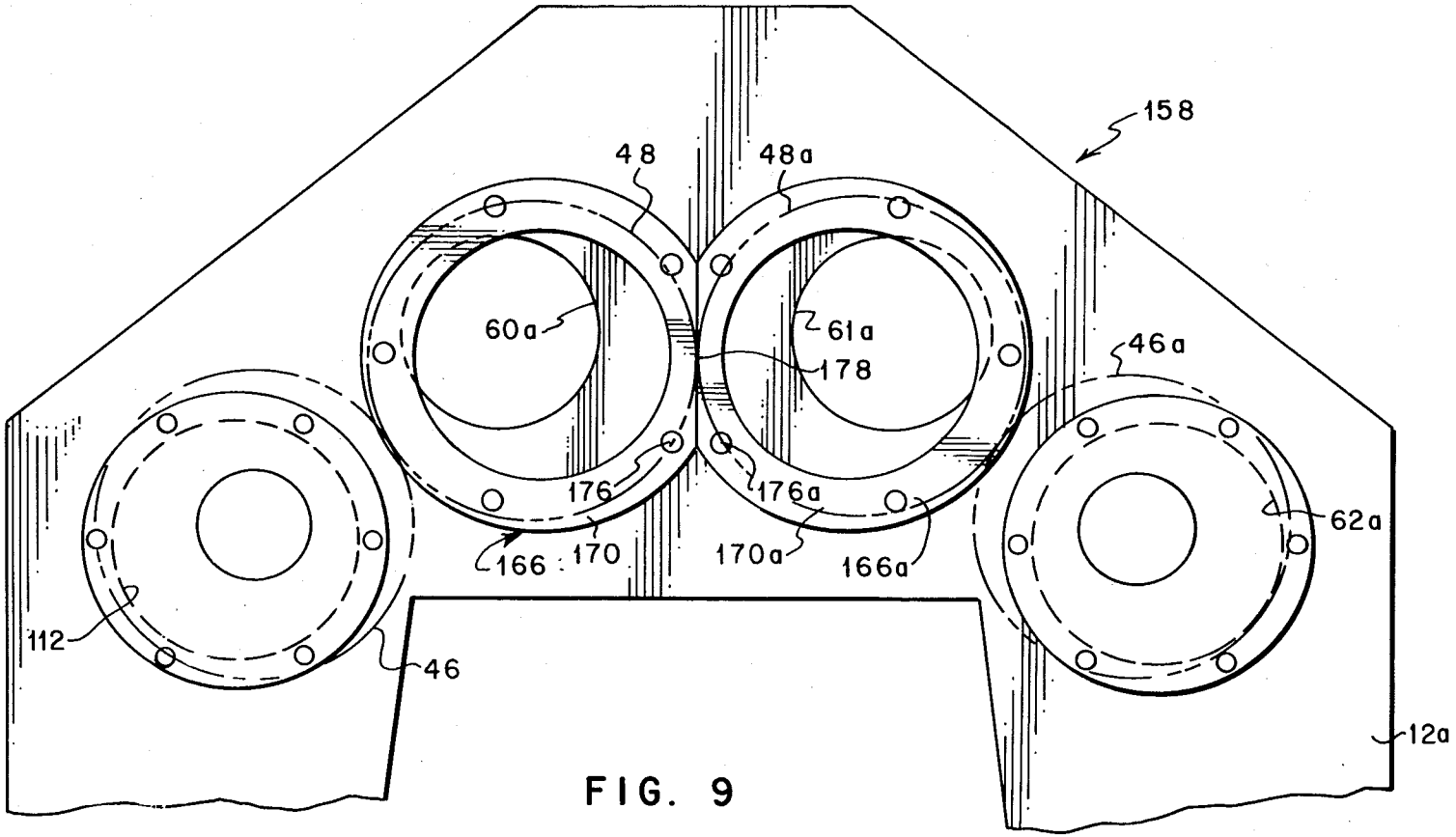
FIG. 9 is a view similar to that of FIG. 3, but with the cylinders shown in phantom.

Referring now to FIG. 8 and FIG. 9, a preferred embodiment of the present invention is referred to generally by reference numeral 158. A support bracket 160 consisting of a support ring 162 and a pilot 164, which is similar to the support brackets shown in the previous embodiments, acts as an internal support means for the operating end of blanket cylinder 48.

Figure 10:
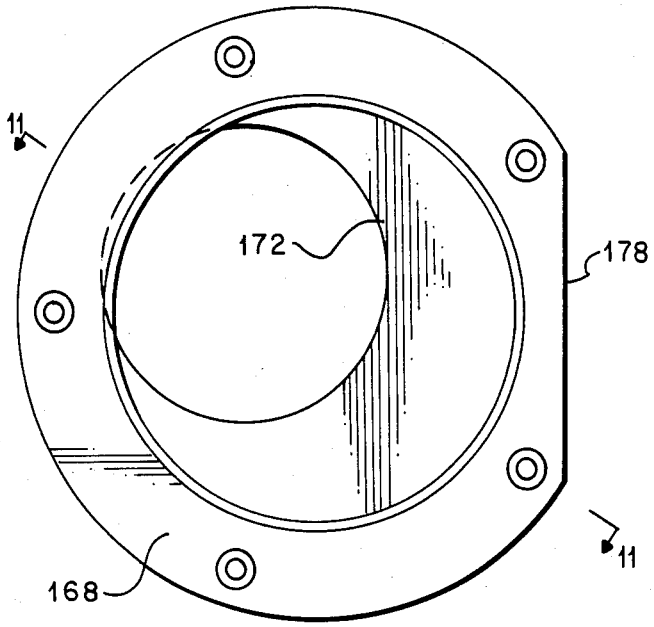
FIG. 10 is an enlarged view similar to that of FIG. 9 of a means for rotatably supporting offset cylinders shown in FIG. 8 and FIG. 9.
Figure 11:
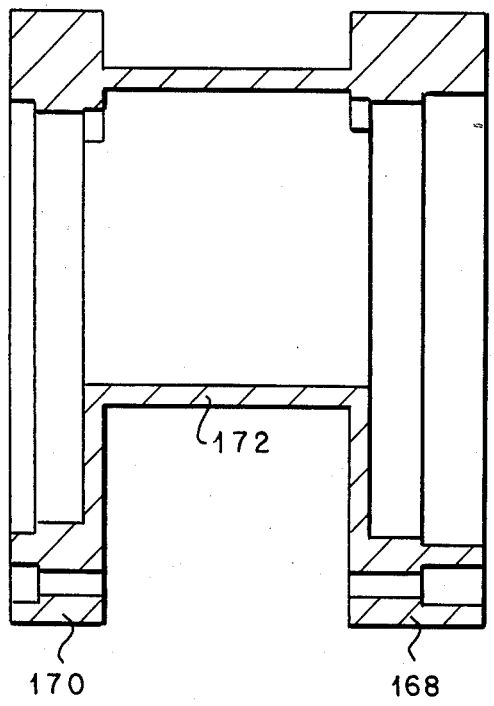
FIG. 11 is a cross-sectional view taken along line 11—11 in FIG. 10.

Referring also to FIG. 10 and FIG. 11, a support assembly 166 includes internal support ring 168, external support ring 170 and pilot 172 which also acts as means for rigidly connecting internal support ring 168 to external support ring 170. Pilot 172 thus acts as means for rigidly connecting the external support bracket to the internal support bracket and locating the brackets with respect to the bore. Shaft 52 of blanket cylinder 48 and pilot 172 extend through bore 60*a* when support assembly 166 is installed. Support assembly 166 is held in place by internal bolts 174 and external bolts 176. The addition of shims between internal support ring 168 and frame 12*a* or between external support ring 170 and frame 12*a* on installation may be necessary to achieve a tight fit.

Referring in particular to FIG. 9, a support assembly 166*a* similar to support assembly 166 is installed to support blanket cylinder 48*a*. Support rings 170 and 170*a* are designed to be large enough to form an interface 178 to aid in correctly positioning the two support assemblies.

Figure 12:
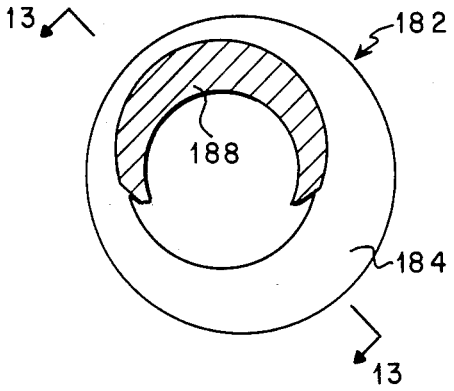
FIG. 12 is a cross-sectional view of a sleeve according to the present invention for use with the mens for rotatably supporting an offset cylinder shown in FIG. 10 and FIG. 11.
Figure 13:
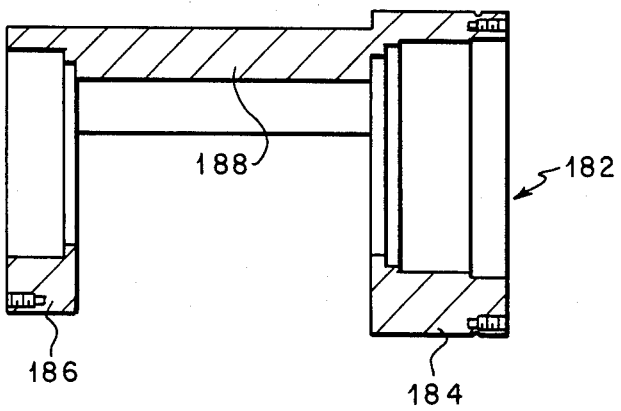
FIG. 13 is a cross-sectional view taken along line 13—13 in FIG. 12.

Referring also to FIG. 12 and FIG. 13, means for bodily swinging blanket cylinder 148 through a short radius arc includes eccentric sleeve 180 rotatably supported by support bracket 160 on the operating side and pass through eccentric sleeve 182 which is part of support assembly 166, rotatably supported by support rings 168 and 170. Pass through eccentric sleeve 182 comprises an internal eccentric sleeve 184, rotatably supported by internal support sleeve 168, an external eccentric sleeve 186 rotatably supported by external support ring 170 and means 188 for rigidly affixing internal eccentric sleeve 184 to external eccentric sleeve 186. Means 188 in a preferred arrangement does not connect the entire peripheries of internal eccentric sleeve 184 and external eccentric sleeve 186, thereby reducing the required size of bore 60*a*.

Since internal support ring 168 is rigidly connected to external support ring 170 and pass through eccentric sleeve 182 is entirely supported by the support rings, support assembly 166, in a preferred method, is completely assembled on the cylinder shaft prior to installation.

From the foregoing it will be seen that this invention is one well adapted to attain all of the ends and objects hereinabove set forth, together with other advantages which are obvious and which are inherent to the apparatus. It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In an offset press unit having a main frame defining a pair of spaced apart walls having bores therein, a pair of plate cylinders rotatably supported within said frame and disposed in spaced apart relation, and a pair of blanket cylinders rotatably supported within said frame disposed for rolling contact with each other and with one of said plate cylinders, internal support means secured to at least one of said walls including at least one bearing entirely inside the main frame rotatably supporting at least one of said cylinders and external support means secured to the other of said walls including at least one bearing entirely outside the main frame, said at least one cylinder supported by said internal support means including a shaft extending through one of said bores in said main frame supported by said at least one bearing of said external support means wherein said internal support means includes separate portions each secured to one of said walls of said main frame, each said portion having at least one bearing entirely inside said main frame rotatably supporting said at least one of said cylinders, wherein one portion of said internal support means includes at least one bracket secured to said one of said walls of said main frame housing said at least one bearing thereof, and said other portion thereof and said external support means includes at least one assembly including an internal support ring housing said at least one bearing of the other portion of said internal support means, an external support ring housing said at least one bearing of said external support means and a pilot interconnecting said internal and external support rings.

2. In an offset press unit as claimed in claim 1 wherein said pilot is integrally formed with said internal and external support rings and eccentrically disposed with respect thereto and is disposed within one of said bores in said main frame.

3. In an offset press unit as claimed in claim 2 wherein said assembly further includes a pass through eccentric sleeve comprising an internal eccentric sleeve rotatably supported upon said internal support ring, external eccentric sleeve rotatably supported upon said external support ring, and connecting means connecting at least a portion of said external eccentric sleeve to a portion of said internal eccentric sleeve.

4. In an offset press unit as claimed in claim 3 wherein said internal and external eccentric sleeves include bearings rotatably supporting said shaft of said at least one of said cylinders.

5. In an offset press unit as claimed in claim 1 wherein one portion of said internal support means includes a plurality of said brackets and the other portion thereof and said external support means includes a plurality of said assemblies, said brackets and assemblies supporting a plurality of said cylinders.

6. In an offset press unit as claimed in claim 5 wherein said one portion of said internal support means includes a pair of said brackets and said other portion thereof and said external support means includes a pair of said assemblies, said brackets and assemblies supporting said blanket cylinders.

7. An assembly for rotatably supporting a printing press cylinder having a cylinder shaft in a printing press main frame which forms bores of predetermined locations, comprising in combination:

an external support ring for supporting the cylinder;

an internal support ring for supporting the cylinder;

a pilot for rigidly connecting the external support ring to the internal support ring and locating the rings with respect to a bore of predetermined location wherein the cylinder shaft and the pilot for rigidly connecting the rings extend through the bore when the assembly is installed, wherein each said ring includes a bearing and said assembly further includes an internal eccentric sleeve rotatably supported on said internal support ring bearing, an external eccentric sleeve rotatably supported on said external support ring bearing, means rigidly interconnecting said internal and external sleeves, and said internal and external sleeves include bearings for rotatably receiving a shaft therein.

* * * * *